United States Patent [19]

Sasaki

[11] 4,432,104

[45] Feb. 21, 1984

[54] BATHING EQUIPMENT FOR THE HANDICAPPED

[76] Inventor: Jack S. Sasaki, 3231 Wellington Ave., Vancouver, British Columbia, Canada, V5R 3X9

[21] Appl. No.: 393,181

[22] Filed: Jun. 28, 1982

[51] Int. Cl.[3] ..... A47K 3/12

[52] U.S. Cl. ..... 4/555; 4/560

[58] Field of Search ..... 4/538, 540, 546, 547, 4/553–555, 557, 559–561, 571, 573, 574, 578, 579, 584, 589, 590, 604, 605, 661; 248/430; 5/81 B

[56] References Cited

U.S. PATENT DOCUMENTS

| | | | |
|---|---|---|---|
| 2,079,739 | 5/1937 | Houseweller | 4/584 |
| 3,380,078 | 4/1968 | Hanson | 4/590 |
| 3,662,409 | 5/1972 | Johansson | 4/560 |
| 3,703,733 | 11/1972 | McLoughlin | 4/560 |
| 4,099,272 | 7/1978 | Sowder | 4/555 |
| 4,359,791 | 11/1982 | Thomas | 4/560 |

*Primary Examiner*—John W. Shepperd
*Assistant Examiner*—Kenneth S. Putnam
*Attorney, Agent, or Firm*—Beehler, Pavitt, Siegemund, Jagger & Martella

[57] ABSTRACT

Bathing equipment includes a tub having a gate for admitting a handicapped bather who is unable to step over a rim of a tub in a normal manner. The tub is supported on a base which places the bottom of the tub near the height of a seat on a wheelchair. The tub is equipped with a bath chair for transferring a seated bather from the gate end of the tub to the opposite end. Guides in the tub support the bath chair during back and forth travel between opposite ends of the tub.

10 Claims, 9 Drawing Figures

BATHING EQUIPMENT FOR THE HANDICAPPED

BACKGROUND OF THE INVENTION

This invention relates to a bathtub and ancillary equipment particularly intended for use by those who are disabled.

A conventional bathtub can prove to be difficult and even dangerous for a person to use who has even a slight physical handicap and others such as those who are elderly, infirm, or partially paralyzed are often denied a proper bath unless assistance is available. In hospitals as well as other institutions, it is common practice to employ some form of hoisting equipment to raise a handicap patient and lower him into a tub where he must be washed by an attendant before being removed again using the same equipment. The tub in this instance must of necessity be deep and of small circumference so that the patient can be seated in an upright and suitably supported position which makes the entire bathing operation an awkward and time consuming task to perform. The suggestion has been made to construct institutional bathtubs so that they can be entered through a side or end door but the problem remains of properly seating and supporting the patient once entered into such a tub and no solution to this problem appears to be offered by the presently available equipment.

SUMMARY OF THE INVENTION

The present invention contemplates an end-entry tub which is supported on a base at wheelchair height. A special bathing chair in the tub allows the user to transfer from his wheelchair to the special chair through the end entrance of the tub and to move on the special chair to the opposite end of the tub where he can sit upright or slightly reclined with his legs stretched out before him in the normal and most comfortable position for bathing. Since the bather is able to assume this position, the amount of water required in the tub is not much greater than usual and, if an orderly is in attendance, then the orderly finds it relatively easy to lean over the waste-high rim of the tub and lend any assistance needed to complete the bath.

DESCRIPTION OF THE PREFERRED EMBODIMENTS

Figure 1:
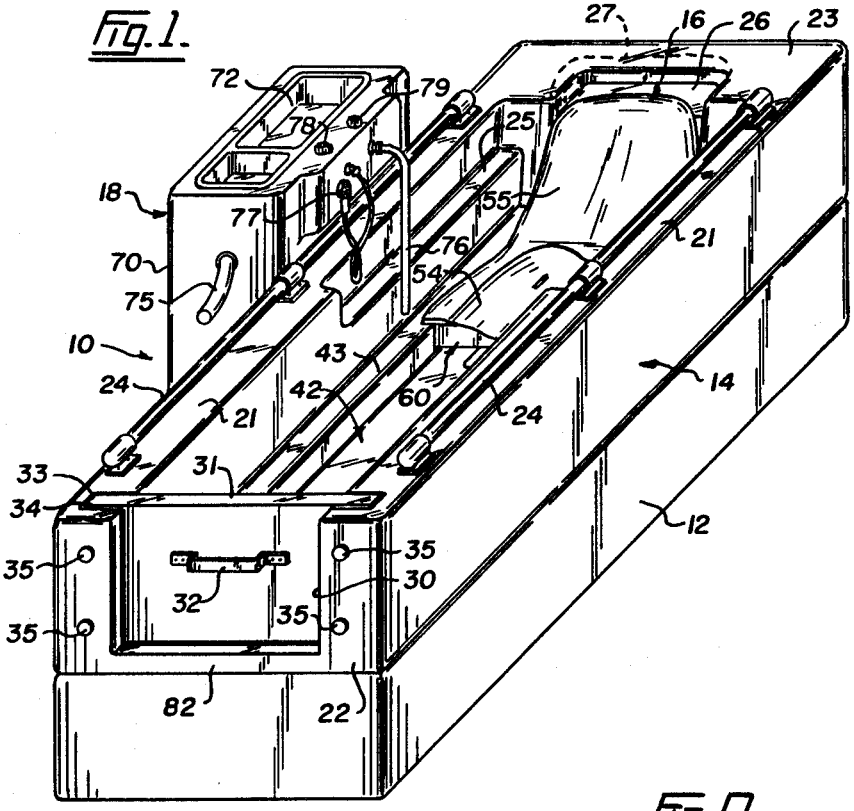
FIG. 1 is a perspective view showing a tub and associated parts of the present bathing equipment.

Referring to the drawings, in FIG. 1 the numeral 10 indicates generally bathing equipment constructed in accordance with the present invention. The equipment comprises a hollow base 12 on which a tub 14 is mounted. The tub is provided with a chair 16 intended to support a handicapped bather. Water is supplied to the tub by means of a mobile unit 18.

The tub generally indicated at 14 has a bottom 20, sides 21, a foot end 22 and a head end 23. Longitudinally extending hand rails 24 are mounted on the rim of a tub above the sides 21. Near the head end and below the rim, the sides 21 are recessed to provide deep, elongated arm rests 25. The rim at the head end of the tub is also recessed as at 26 to support a removable head rest 27 which is shown by dotted lines in FIG. 1 only. The foot end 22 of the tub is provided with a large entrance opening 30 which is closed by means of a gate 31 having a handle 32. This vertically movable gate is mounted in grooves 33 which are formed in the opposing faces of the sides 21 and partly in the bottom 20. As shown best in FIG. 2, the outer face of the gate is fitted with a gasket 34 which is substantially U-shaped so as to enter the grooves and bear against the inner surfaces of the grooves at the sides and bottom of the tub. Clamping bolts 35 are rotatably mounted in the foot end to turn against collars 36 which are fixed to the rearmost face of the tub end. The threaded inner end of each bolt is received in a nut 37 which is embedded in the gate. The bolts 35 when backed off clear of the nuts allow the gate to be lifted vertically and removed completely from the tub. When the gate is reinserted into the grooves and the clamping bolts 35 are again tightened into the nuts, a watertight seal is ensured for the gate within the entrance opening 30.

Figure 3:
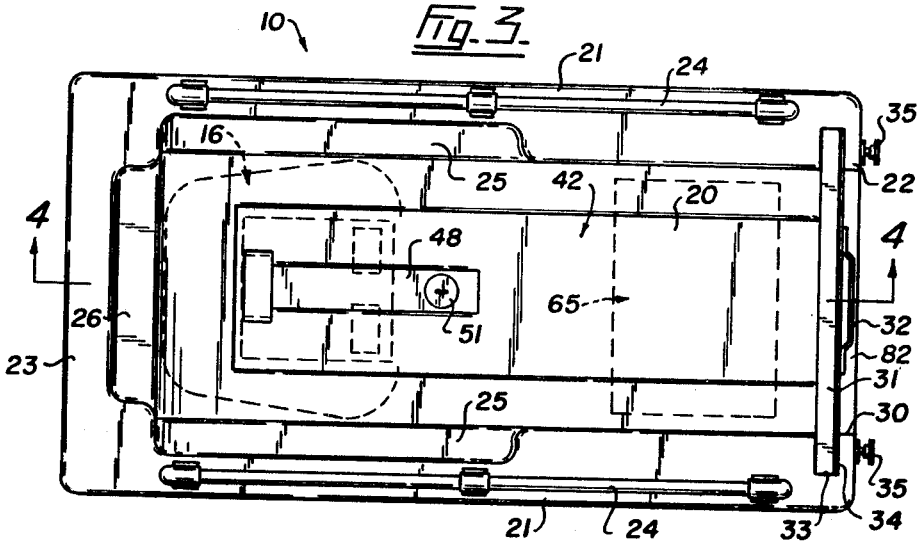
FIG. 3 is a plan view of the tub.
Figure 4:
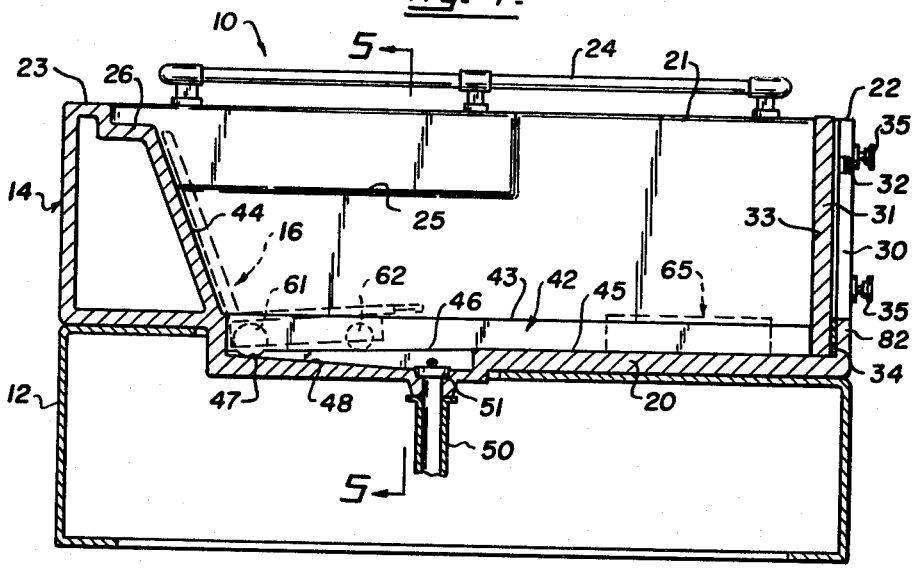
FIG. 4 is a longitudinal section taken on the line 4—4 of FIG. 3.
Figure 5:
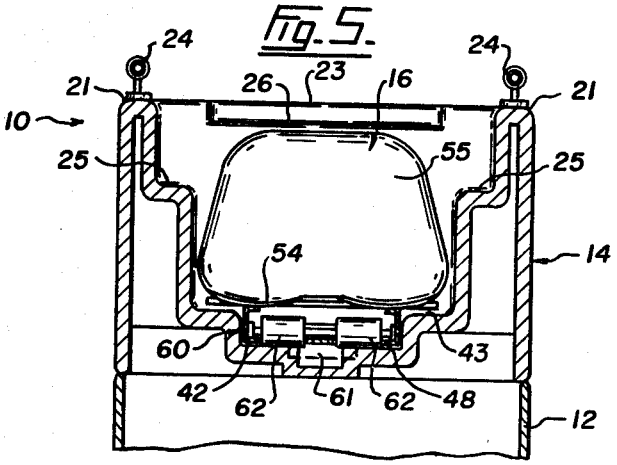
FIG. 5 is a vertical section taken on the line 5—5 of FIG. 4.

Referring now particularly to FIGS. 3, 4 and 5, the tub will be seen to be provided with means for guiding the bath chair 16 as is moved between opposite ends of the tub. The guide means is shown to comprise a rectangular guide channel 42 which extends below the uppermost surface 43 of the tub bottom spaced from the inner surfaces of the sides 21 and terminating at inner surface 44 of the head end 23. In FIG. 4, it will be seen that the bottom of the guide channel 42 has a level portion 45 near the foot end of the tub and from this level portion the channel slopes downwardly towards the head end to provide a ramp portion 46. A substantially semi-circular depression 47 extends across the ramp portion 46 below the head end surface 44. The depression 47 connects with a relatively narrow drain channel 48 which is formed in the tub bottom below the ramp portion 46. The rectangular drain channel slopes downwardly from the depression 47 to a point near the level portion 45 where there is an oversized drain 50 which is fitted with a plug 51.

Figure 6:
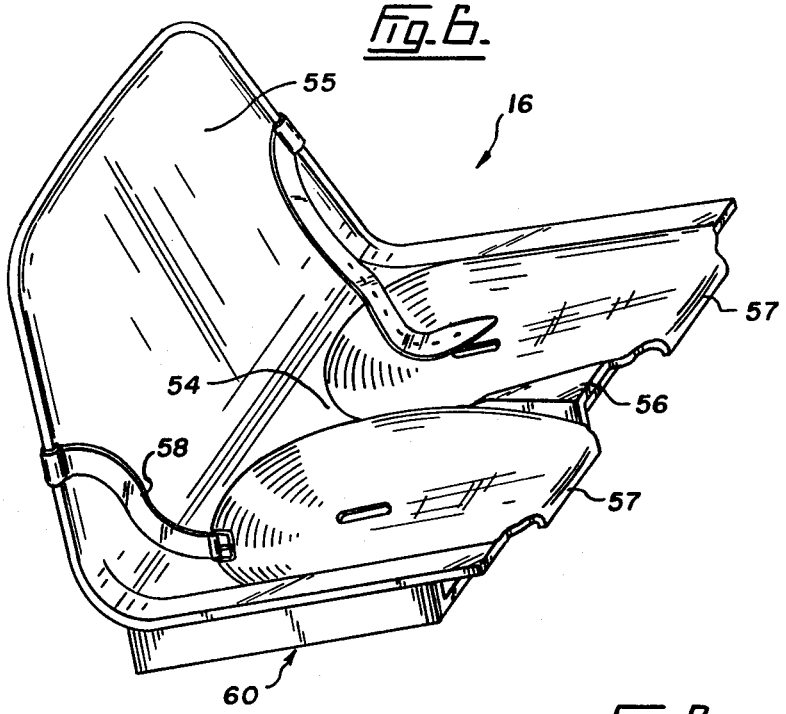
FIG. 6 is a perspective view of a bath chair for the tub.
Figure 7:
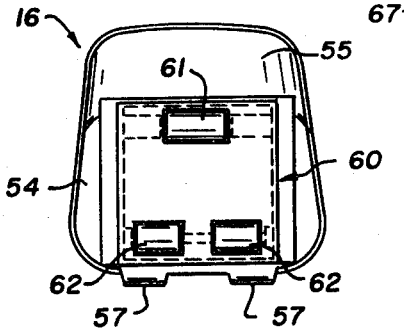
FIG. 7 is a plan view of the underside of the bath chair.

The bath chair generally indicated at 16 is shown best in FIGS. 5, 6 and 7 to comprise a seat 54 and a back 55 both suitably molded preferably of a thin plastic material to fit the contours of the body. The forward edge of the seat 54 is shaped to provide a centrally disposed lift handle 56 which is located between two downwardly extending flanges 57. The side edges of the seat project over the bottom surface 43 of the tub, see FIG. 5, and the side edges of the back are fitted with a belt 58 which can be buckled up to support someone seated in the chair.

The bath chair 16 is mounted on a box-like base frame 60 suitably secured to the underside of the seat 54. This base frame is received in the guide channel 42 and is a fairly snug fit therein, that is, it cannot rotate to any appreciable extent about a vertical axis but is free to slide back and forth moving longitudinally of the tub. A single roller 61 is rotatably supported on the lowermost part of the frame 60 and so is a pair of transversely aligned rollers 62 which have a smaller diameter than the single roller. It will be noted that the length of the transversely extending and centrally disposed roller 61 is such as to bridge the drain channel 48 when the chair is being rolled up or down the ramp portion 46 of the guide channel. The pair of rollers 62 are located in front of the single roller and are spaced apart so as to roll along the lower surfaces of both the level portion 45 and the ramp portion 46 when the chair is moved back and forth along the guide channel 42.

Figure 8:
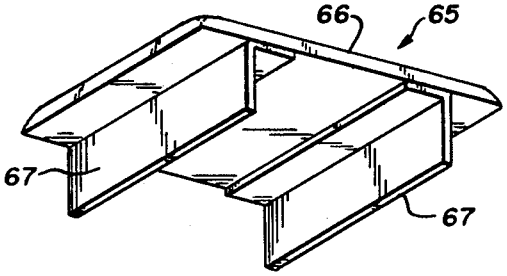
FIG. 8 is a perspective view of a leg support for the tub.

The present tub is provided with a leg support 65 which is shown by dotted lines in FIGS. 3 and 4 and by solid lines in FIG. 8. This leg support is simply a rectangular board 66 having parallel guide members 67 dependent from its underside. The guide members are spaced apart a distance which allow them to fit into the guide channel 42 when the leg support is placed across the bottom of the tub near the foot end. Thus, the leg support 65 can be slidably supported in the tub and be selectively positioned lengthwise of the level portion 45 at which time the support is held by the guide members against moving transversely of the tub.

Figure 9:
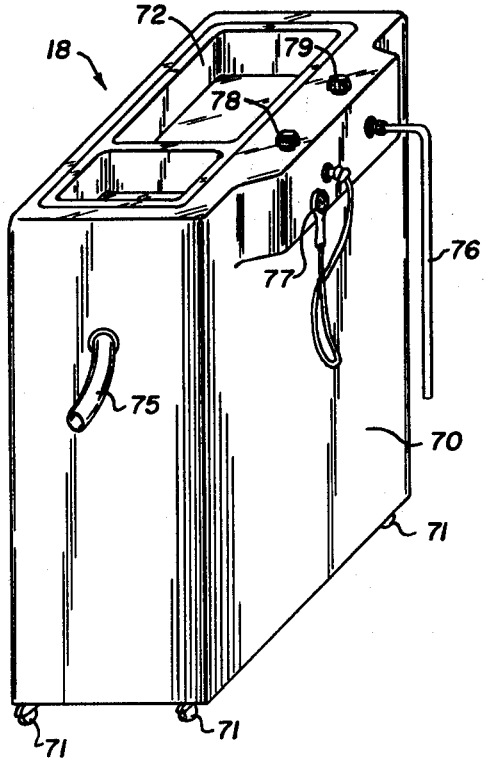
FIG. 9 is a perspective view of a water control unit for the present bathing equipment.

Most institutions make it manditory for an orderly or other attendant to fill each tub with water since it is often difficult for the handicapped to do so without risk of injury to themselves, or risking flooding. In order to facilitate the filling of the tub by a single orderly, the equipment 10 includes the control unit generally indicated at 18 and which is shown in FIGS. 1 and 9. The control unit 18 comprises a cabinet 70 which is mounted on casters 71 and is fitted at the top with basins 72 adapted to carry soap, sponges and the like. A length of hose 75 connects the cabinet to a source of bathing water kept at a desired temperature by a thermostat. The water delivered to the cab is conducted through pipes, not shown, to an outlet hose 76 and a spray head 77 with the flow through the pipes being controlled by taps 78 and 79. A mobile control unit of this type can be wheeled from tub to tub by the attendant who fills each tub with the required amount of water.

Figure 2:
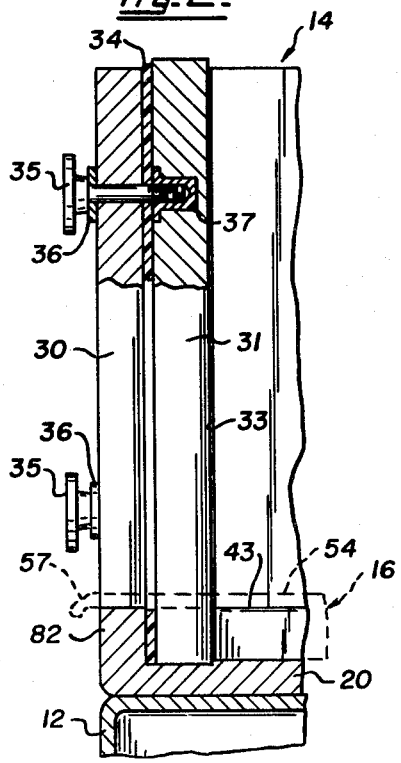
FIG. 2 is an enlarged view part vertical section and part elevation showing means for sealing a gate at the foot end of the tub.

The tub 14 is readied to receive a bather who will be assumed to be the occupant of a wheelchair. An attendant probably would be required to assist such a bather and the attendant first removes the gate 31 and the leg support 65 both of which are then positioned nearby. The bath chair 16 is moved up onto the level portion 45 as far forward as permitted by a sill 82, see particularly FIG. 2, which is provided on the lower edge of the entrance opening. At this time, the base frame 60 bears against the inner face of the sill and the flanges 57 of the slightly flexible seat 54 are in latching engagement with the top edge of the sill as shown in FIG. 2. The relatively large diameter roller 61 tilts the seat forward and thus the chair 16 is held and positioned to receive the bather. With the bath chair releasably secured in this position, the bather transfers from his wheelchair to the bath chair and, if necessary, is secured against forward collapse by use of the seat belt 58. The bath chair with the bather seated therein is then pushed slightly to snap the flanges 57 off the sill 82 and is rolled along the level portion 31 and down the ramp portion 46 until the single roller 61 drops into the depression 47. The seat 54 slopes down towards the head end of the tub due to the ramp 46 and the back 55 is parallel and in close proximity to the surface 44. It may be desirable for the legs of the bather to be carried in a slightly elevated position in which case, the leg support 65 is replaced in the bottom of the tub so as to be engaged by the calf muscles of the leg. The gate is replaced and positively sealed using the clamping bolts 35 whereupon the tub is ready to be filled with water.

The attendant wheels the mobile unit 18 up to a suitable position alongside the tub where he may elect to use the outlet hose 76 to add the required amount of heated water to the tub. It will be noticed that the seat 54 of the bath chair is disposed substantially at the same level as the upper surface of the bottom of the tub and that the chair supports the bather in what is regarded as a normal bathing position. The amount of water required therefore is no greater than is needed in a conventional tub as used by a person who is not incapacitated and the occupant of the present tub is comfortably seated and supported to bath by himself if he is able or do so or to be washed by the attendant. Assuming the attendant leaves the bather to control the water supply and for some reason the disabled person cannot manipulate the tap 78 and there is danger of flooding, the person occupying the bath chair will find the drain plug immediately in front of him in a readily accessible position to be pulled to empty the tub.

From the foregoing, it will be apparent the present invention provides equipment which will enable a weakened or disabled person to bath in a normal seated position. The bath chair is held against accidental movement at both the foot and head ends of the tub and this is an important safety feature for anyone who is not young or physically fit and is required normally to use a wheelchair and to transfer from that chair to a bath chair. In an emergency, the tub can be drained very quickly due to the provision of the oversize drain at the low end of a large drain channel. The present equipment includes the mobile water supply unit which is preferred for institutions and the like where perhaps a group of the tubs are located in one room but it will be appreciated that in a private home or elsewhere the tub can be supplied with water through taps such as may be formed in a conventional tub.

I claim:

1. Bathing equipment for a handicapped bather normally requiring a wheelchair, said equipment comprising:

a tub having a bottom surface extending between foot and head ends of the tub, a base supporting the tub to dispose the bottom surface substantially at the height of a seat on the wheelchair, said tub having an entrance opening at the foot end, a gate mounted on the foot end to close the entrance opening and contain the bath water, a bath chair installed in the tub, and guide means within the tub supporting the bath chair for movement along the bottom surface between the head and foot ends whereby a bather transferred to the bath chair at the foot end from the wheelchair is movable back first and in a sitting, legs outstretched, position to the head end of the tub, said guide means comprising a guide channel extending longitudinally of the bottom surface, said guide channel having a level portion for supporting the bath chair near the gate and a ramp portion for supporting the bath chair near the head end of the tub, said bath chair having a wheel base frame endwise movable within the guide channel and a seat projecting laterally of the base frame over the bottom surface.

2. Bathing equipment as claimed in claim 1, and including a drain channel formed in the tub below the ramp portion, said drain channel leading downwardly to a drain for the tub located ahead of the bath chair at the head end of the tub.

3. Bathing equipment as claimed in claim 1, and including a leg support placeable in the tub to bridge the guide channel above the level portion.

4. Bathing equipment as claimed in claim 1, in which said foot end of the tub is provided with grooves in which the gate is slidably supported to be lifted vertically and removed from the tub, a gasket interposed between opposing surfaces of the grooves and the gate, and clamping means on the tub for compressing the gasket to ensure a watertight seal for the gate.

5. Bathing equipment as claimed in claim 1 and including means for releasably securing the bath chair against inadvertent movement away from the foot end of the tub.

6. Bathing equipment for a handicapped bather normally requiring a wheelchair, said equipment comprising;

a tub having a bottom surface, sides, a head end, and a foot end provided with an entrance opening;

a base supporting the tub with the bottom surface substantially at the height of a seat on the wheelchair, a gate mounted on the foot end to provide a watertight closure for the entrance opening, said tub having a guide channel extending longitudinally of the bottom surface between the head and foot ends, said guide channel including a level portion adjacent the gate and a ramp portion adjacent the head end, a bath chair mounted in the tub for back and forth movement along the guide channel, said bath chair having a seat generally at the level of the bottom surface and a base frame supporting rollers received within the guide channel, a leg support mounted on the bottom surface to bridge the guide channel, means for supplying water to the tub, and means for draining the tub.

7. Bathing equipment as claimed in claim 6, in which said means for supplying water to the tub includes a mobile control unit movable to selected positions alongside the tub.

8. Bathing equipment as claimed in claim 7, in which said means for draining the tub comprises a drain channel located in the guide channel and sloping downwardly to conduct water to a drainage point approximately midway between the head and foot ends of the tub, and a drain fitted with a plug at the drainage point.

9. Bathing equipment as claimed in claim 8, in which said guide channel has a level portion adjacent the gate and a ramp portion sloping downwardly from the level portion to the head end, and a depression formed in the ramp portion near the head end to seat a roller of the bath chair.

10. Bathing equipment as claimed in claim 6, in which said seat of the bath chair is provided with a latch member, and said tub having a part adapted to be latchingly engaged by the latch member when the bath chair is at the foot end of the tub.

* * * * *